313-422 SR
2/11/86 OR 4,570,100

United States Patent [19]

Sato et al.

[11] Patent Number: 4,570,100

[45] Date of Patent: Feb. 11, 1986

[54] FLAT-TYPE CATHODE RAY TUBE HAVING ELECTROSTATIC AND ELECTROMAGNETIC DEFLECTION SYSTEMS

[75] Inventors: Hiroki Sato, Chiba; Masato Hatanaka, Koshigaya; Toshio Ohhoshi; Sakae Tanaka, both of Tokyo, all of Japan

[73] Assignee: Sony Corporation, Tokyo, Japan

[21] Appl. No.: 478,527

[22] PCT Filed: Jul. 16, 1982

[86] PCT No.: PCT/JP82/00270

§ 371 Date: Mar. 22, 1983

§ 102(e) Date: Mar. 22, 1983

[87] PCT Pub. No.: WO83/00406

PCT Pub. Date: Feb. 3, 1983

[30] Foreign Application Priority Data

Jul. 22, 1981 [JP] Japan ..... 56-114833

[51] Int. Cl.[4] ..... H01J 29/72

[52] U.S. Cl. ..... 313/422

[58] Field of Search ..... 313/422, 433; 315/366

[56] References Cited

U.S. PATENT DOCUMENTS 4,451,756 5/1984 Sato et al. ..... 313/422

FOREIGN PATENT DOCUMENTS 461625 1/1971 Japan .

*Primary Examiner*—Palmer C. DeMeo
*Assistant Examiner*—Sandra L. O'Shea
*Attorney, Agent, or Firm*—Hill, Van Santen, Steadman & Simpson

[57] ABSTRACT

A flat-type cathode ray tube is disclosed which comprises a flat tube envelope (1) in which first and second electrodes (2) and (3) are provided to face each other in the thickness direction of the envelope for presenting a first deflection system to perform an electrostatic deflection, a phosphor screen (4) is formed on the side of the first electrode (2), and a second deflection system (6) is formed between the first deflection system and an electron gun (5) to perform an electromagnetic deflection. A third electrode (10) sufficiently surrounding the region of the second deflection system (6) is formed integral with the second electrode (3) and the second and third electrodes (3) and (10) are supplied with a voltage lower than that of the first electrode (2). This flat-type cathode ray tube can reduce a power consumption and suppress a circular-arc distortion.

1 Claim, 11 Drawing Figures

FLAT-TYPE CATHODE RAY TUBE HAVING ELECTROSTATIC AND ELECTROMAGNETIC DEFLECTION SYSTEMS

TECHNICAL FIELD

This invention relates generally to flat-type cathode ray tubes and more particularly is directed to a flat-type cathode ray tube which can reduce power consumption and also can alleviate a circular-arc distortion.

BACKGROUND ART

In an ordinary cathode ray tube such as a television picture tube and so on, an electron gun is opposed to a phosphor screen and is extended backward along the direction substantially perpendicular to the phosphor screen with a result that a depth of a cathode ray tube envelope is considerably large. Whereas, a so-called flat-type cathode ray tube has been proposed that its electron gun is extended along the surface direction of the phosphor screen for making the tube envelope flat.

FIG. 1 schematically illustrates an example of such previously proposed flat-type cathode ray tube. In the figure, reference numeral 1 generally denotes a flat tube envelope, and in this flat tube envelope 1 are provided a target electrode 2 and a back electrode 3. These electrodes 2 and 3 are opposed to each other in the thickness direction of the flat tube envelope 1 (that is, the up-and-down-direction in the drawing). On the target electrode 2 is formed a phosphor screen 4. An electron gun 5 is provided on a plane which is parallel to and remote from the phosphor screen 4. Between the electron gun 5 and the phosphor screen 4 is provided a deflection coil 6 to deflect the electron beam emitted from the electron gun 5.

In such arrangement, to the target electrode 2 is applied a high voltage, for example, 10 KV and to the back electrode 3 is applied a voltage somewhat lower than the former, for example, 6 KV. As a result, the target electrode 2 and the back electrode 3 constitute an auxiliary deflection plate.

In such example, the target electrode 2 is extended to the position near the electron gun 5, surrounding the deflection region by the deflection coil 6, and the potential of the target electrode 2 is high, for example, 10 KV as compared with the potential of the back electrode 3, for example, 6 KV so that as shown in FIG. 2, within the flat tube envelope 1, particularly in the upper portion thereof is formed a diverging lens. Thus, the beam emitted from the electron gun 5 is diverged with a disadvantage that the circular-arc distortion is increased.

Moreover, in such example, since the target electrode 2 forming the auxiliary deflection plate is same in potential as a last grid 5*a* of the electron gun 5, the beam emitted from the electron gun 5 is never accelerated further. Therefore the power consumption of the cathode ray tube is urged to increase.

DISCLOSURE OF INVENTION

In view of such aspects, it is an object of this invention to provide a flat-type cathode ray tube which reduces power consumption as well as alleviates a circular-arc distortion.

In accordance with this invention, in order to perform such a purpose, in a flat-type cathode ray tube comprising a flat tube envelope in which first and second electrodes are located to face each other in the thickness direction of the envelope to thereby form a first deflection system for performing an electrostatic deflection, a phosphor screen is formed at the side of the first electrode and a second deflection system is formed between the first deflection system and an electron gun for performing an electromagnetic deflection, a third electrode surrounding a region of the second deflection system sufficiently is formed integrally with the second electrode and a voltage lower than that of the first electrode is applied to the second and third electrodes.

BEST MODE FOR CARRYING OUT THE INVENTION

Figure 1:
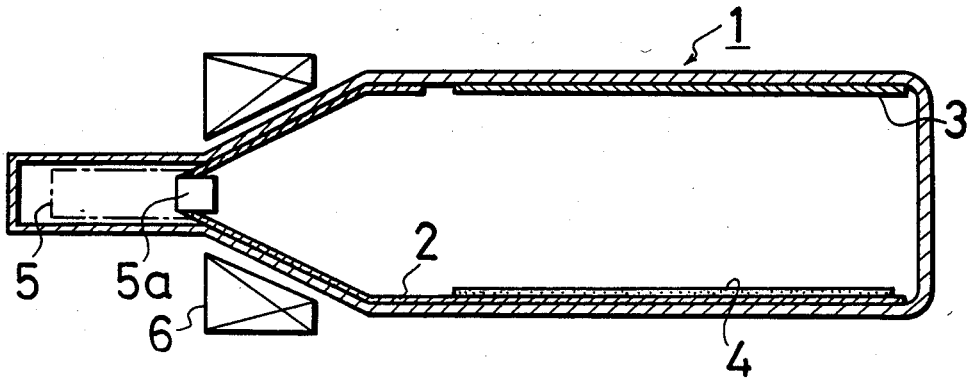
FIGS. 1 and 2 are both schematic diagrams useful for the explanation of the present invention.
Figure 2:
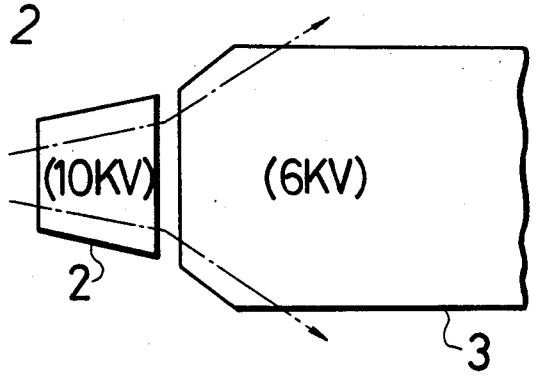
Figure 3:
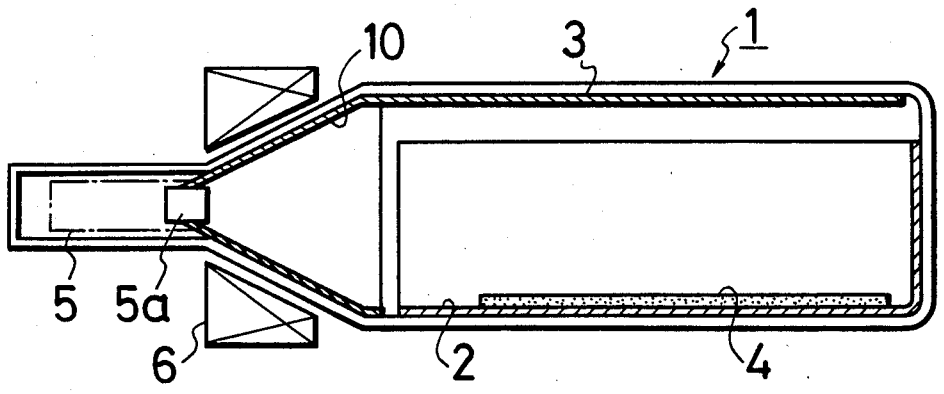
FIG. 3 is a cross-sectional diagram showing an embodiment of the present invention.

Hereinafter, an embodiment of this invention will be described with reference to FIG. 3 and the following drawings. In FIG. 3, like parts corresponding to those of FIG. 1 are marked with the same references and the detailed descriptions thereof will not be made.

Figure 4:
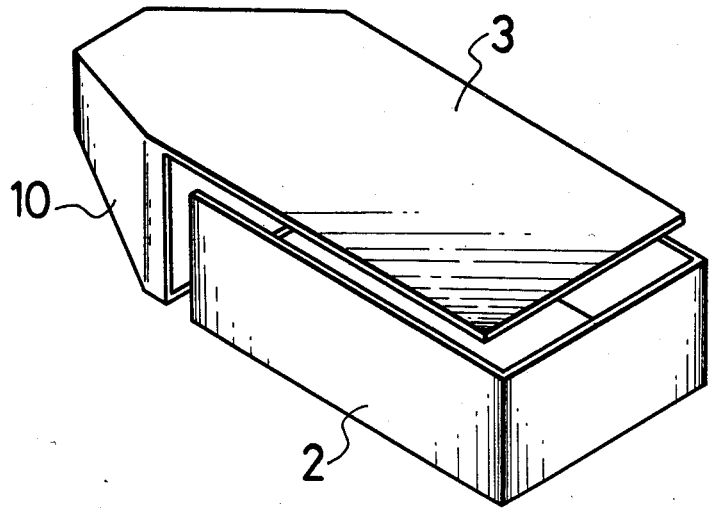
FIGS. 4 to 8 are all schematic diagrams useful for the explanation of the example of FIG. 3, FIGS. 9*a* and 9*b* are a diagram showing a modified examples

In FIGS. 3 and 4, there is formed a funnel-shaped electrode 10 which is integral with the back electrode 3. The electrode 10 having a funnel-like portion is provided to surround the deflection region by the coil 6. The tip end of this funnel-shaped electrode 10 is connected to the last grid 5*a* of the electron gun 5. The potential of the last grid 5*a*, namely, the potential of the back electrode 3 and the funnel-shaped electrode 10 is selected as, for example, 6 KV .

While, the target electrode 2 is formed on the region of the flat tube envelope 1 corresponding to the phosphor screen 4 and the inner side wall surface thereof. In this case, by the target electrode 2 located at the position of the inner side wall surface can be absorbed a secondary electron beam. The potential of the target electrode 2 is selected higher than that of the last grid 5*a*, for example, as 10 KV .

Figure 5:
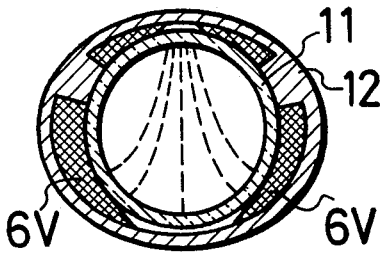
Figure 6:
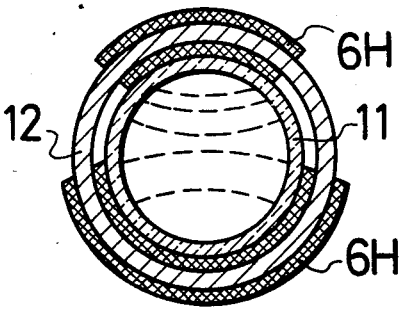

In this embodiment, as the deflection coil 6, there are employed those deflection coils as shown in FIGS. 5 and 6. FIG. 5 shows a vertical deflection coil 6 V formed as a saddle-shape, while FIG. 6 shows a horizontal deflection coil 6 H formed as a troidal shape. In FIGS. 5 and 6, broken lines represent the magnetic fluxes. As will be clear from the figures, magnetic field becomes stronger as the upper part, namely, the side of the back electrode 3 is approached. In the figures, reference numeral 11 denotes a neck tube and 12 a yoke.

With the arrangement thus made, since the target electrode 2 is higher in potential than the last grid 5*a* of the electron gun 5, the electron beam emitted from the electron gun 5 is accelerated until it will land on the target electrode 2. Therefore, the power consumption can be suppressed.

Figure 7:
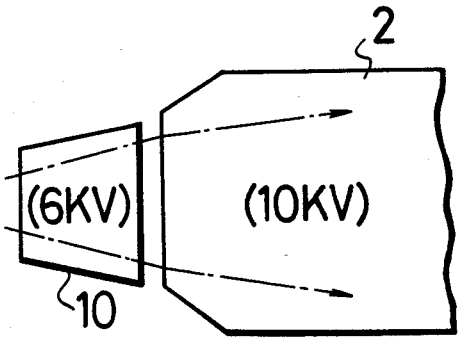

Moreover, since as compared with the funnel-shaped electrode 10, the target electrode 2 is high in potential, as illustrated in FIG. 7, a collimator lens is formed between both the electrodes 2 and 10. As a result, the beam is not diverged more than is necessary and the circular-arc distortion can therefore be alleviated. This means that it is possible to suppress a parabola current which will be superimposed upon the vertical deflection current at every horizontal period so as to remove the circular-arc distortion. Thus, in view of this point, the power consumption can be reduced, too.

In the embodiment, of FIG. 3 in order to absorb the secondary electron beam, the target electrode 2 is elongated to the inner side wall surface of the flat tube envelope 1 so that the electric field is changed much at the side of the back electrode 3, while the electric field is changed less at the side of the target electrode 2. Accordingly, under this state, the beam travelling near the side of the back electrode 3, namely, the beam which will land on the position far away from the electron gun 5 is given a larger force in the lower direction and therefore apt to be given an over convergence as shown by the full lines in FIG. 8. But, according to this embodiment, as illustrated in FIGS. 5 and 6, at the side of the back electrode 3, the magnetic field is strong. Thus, the upper electron beam in the beams is given a larger force in the upper direction by Lorentz force and lands on the farther position from the electron gun 5 as, for example, shown by a one-dot chain line in FIG. 8, with a result that the over convergence, as aforesaid, can be removed.

Figure 8:
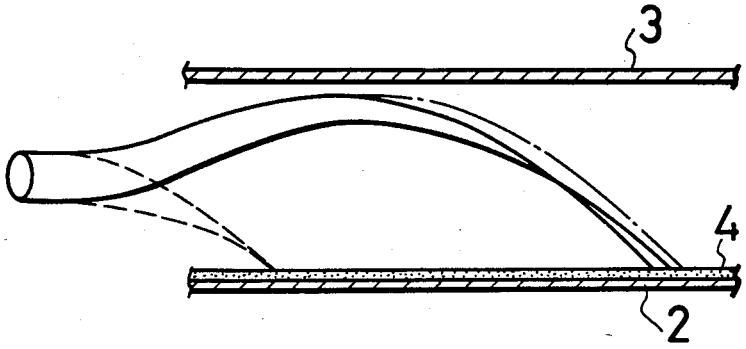

Although the beam which will land near the electron gun 5 as shown by the broken line in FIG. 8 has a long cross-section in the direction perpendicular to the sheet of drawing of FIG. 8, the beam itself lands slantwise, making the spot of beam just circular.

Moreover, with this distribution of magnetic field, the circular-arc distortion is also alleviated.

As stated above, according to the flat-type cathode ray tube of this invention, as compared with the back electrode 3 and the funnel-shaped electrode 10, the target electrode 2 is applied with a high voltage so that the beam can be accelerated post the electron gun 5 and thus the power consumption being reduced. Furthermore, since between the funnel-shaped electrode 10 and the target electrode 2 can be formed the collimator lens, it is possible to suppress the circular-arc distortion.

Figure 9A:
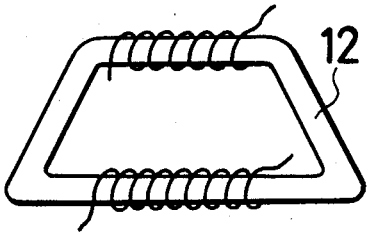
Figure 9B:
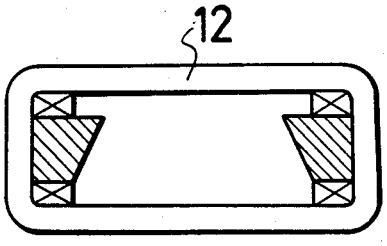
Figure 10:
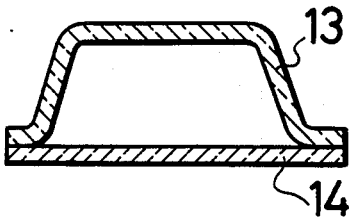
FIG. 10 is a diagram useful for the explanation of the examples of FIGS. 9*a* and 9*b*.

As the yoke of the deflection coil 6, the annular-shaped yoke 12 shown in FIGS. 5 and 6 is employed but a trapezoidal yoke 12 shown in FIGS. 9A and 9B may be used. In this case, due to the configuration of the yoke 12, at the upper portion, a magnetic field is strong and so, a magnetic field similar to that of the example in FIG. 6 can be obtained with ease. The example of FIG. 9, because of the configuration of the yoke 12, can be applied to a situation in which as shown in FIG. 10, the flat tube envelope 1 consists of a funnel-shaped upper member 13 and a flat lower member 14. In this case, there is an advantage that, as the upper member 13, there can be employed such one which can easily be formed by the glass-injection molding.

It is needless to say that this invention is not limited to the aforesaid embodiment but can take various modifications without departing from the spirits or scope of the invention.

We claim:

1. A flat-type cathode ray tube comprising: a flat tube envelope having first and second electrodes formed to face each other in a direction parallel to the path of the electron beam to form a first deflection system for performing an electrostatic deflection; a phosphor screen formed on said first electrode, an electron gun providing said electron beam and located laterally of said phosphor screen and, a second deflection system formed between said first deflection system and said electron gun for performing an electromagnetic deflection of said electron beam in a region defined therebetween, and a third electrode surrounding said region, formed integral with said second electrode, and having a voltage applied thereto lower than that of said first electrode.

* * * * *